US007968494B2

(12) United States Patent
Takano et al.

(10) Patent No.: US 7,968,494 B2
(45) **Date of Patent: *Jun. 28, 2011**

(54) HEAT-SENSITIVE RECORDING MATERIAL

(75) Inventors: Shinji Takano, Numazu (JP); Yoshiaki Matsunaga, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 958 days.

This patent is subject to a terminal disclaimer.

(21) Appl. No.: 11/900,871

(22) Filed: Sep. 12, 2007

(65) Prior Publication Data

US 2008/0096762 A1 Apr. 24, 2008

(30) Foreign Application Priority Data

Sep. 15, 2006 (JP) ..... 2006-251108

(51) Int. Cl.
*B41M 5/42* (2006.01)

(52) U.S. Cl. ..... 503/226; 503/200

(58) Field of Classification Search ..... None
See application file for complete search history.

(56) References Cited

U.S. PATENT DOCUMENTS

| | | | | |
|---|---|---|---|---|
| 5,457,080 | A | 10/1995 | Takano et al. | |
| 5,731,262 | A * | 3/1998 | Ogino et al. | 503/207 |
| 6,890,698 | B2 * | 5/2005 | Naruse et al. | 430/270.1 |
| 7,476,643 | B2 * | 1/2009 | Ikeda et al. | 503/226 |
| 2003/0039917 | A1 | 2/2003 | Naruse et al. | |
| 2006/0063013 | A1 | 3/2006 | Ikeda et al. | |
| 2006/0159913 | A1 | 7/2006 | Kugo et al. | |
| 2007/0184978 | A1 | 8/2007 | Takano | |
| 2007/0225453 | A1 | 9/2007 | Abe et al. | |

FOREIGN PATENT DOCUMENTS

| | | | |
|---|---|---|---|
| EP | 1243439 | A1 | 9/2002 |
| EP | 1637339 | A1 | 3/2006 |
| EP | 1674543 | A1 | 6/2006 |
| EP | 1683816 | A1 | 7/2006 |
| JP | 8-151421 | | 6/1996 |
| JP | 9-324095 | | 12/1997 |
| JP | 10-235996 | | 9/1998 |
| JP | 11-12424 | | 1/1999 |
| JP | 11-314457 | | 11/1999 |
| JP | 3084506 | | 7/2000 |
| JP | 2001-270250 | | 10/2001 |
| JP | 2002-127601 | | 5/2002 |
| JP | 2002-283717 | | 10/2002 |
| JP | 2005-163031 | | 6/2005 |
| JP | 2006-88348 | | 4/2006 |

OTHER PUBLICATIONS

U.S. Appl. No. 11/717,228, Filed Mar. 12, 2007.
European search report in connection with corresponding European patent application No. 07 11 6491, Jan. 22, 2008.
Sep. 7, 2010 Japanese official action in connection with counterpart Japanese patent application.

* cited by examiner

*Primary Examiner* — Bruce H Hess
(74) *Attorney, Agent, or Firm* — Cooper & Dunham LLP

(57) ABSTRACT

A heat-sensitive recording material including: a substrate; a heat-sensitive color developing layer over the substrate, the heat-sensitive color developing layer composed mainly of a leuco dye and a color developer that develops color of the leuco dye upon heating; and a protective layer over the heat-sensitive color developing layer, the protective layer composed mainly of a water-soluble resin and a crosslinking agent, wherein the protective layer contains diacetone-modified polyvinyl alcohol as the water-soluble resin, and N-aminopolyacrylamide as the crosslinking agent.

10 Claims, No Drawings

HEAT-SENSITIVE RECORDING MATERIAL

BACKGROUND

1. Technical Field

This disclosure relates to a heat-sensitive recording material widely used in the fields of printers such as output of computers, calculators, and the like, medical measurement recorders, low-speed and high-speed facsimile machines, automatic ticket vending machines, thermal copiers, handy terminals, and POS system labels, and particularly, to a heat-sensitive recording material improved in acid resistance and water resistance to edible vinegar and the like.

2. Description of the Related Art

Conventionally, there have been various proposals for recording materials, for which provided on a substrate such as a sheet of paper or synthetic paper or a plastic film is a heat-sensitive color developing layer mainly composed of a colorless or light-colored leuco dye and a color developer that develops color of the leuco dye upon contact therewith, utilizing a color developing reaction by heat, pressure, and the like between the leuco dye and the color developer. Advantages of heat-sensitive recording materials of this type, including capability of short-time recording with a relatively simple apparatus without the necessity for applying such complicated processes as development and fixing, low noise level, and low costs, have allowed them to be used as recording materials not only for copying of books, documents, and the like, but also for electronic computers, facsimile machines, ticket vending machines, label printers, recorders, handy terminals, and the like.

As heat-sensitive recording materials, there has been a demand for materials that are capable of quick color development with high density and of imparting high rigidity to color-developed images and backgrounds. Furthermore, in recent years, heat-sensitive recording materials have come to be used in large quantities in the fields of labels, receipts, and the like where reliability of recorded images is regarded as important. Accordingly, there has been a demand for ones that offer high storage stability against water and acidic component substances contained in food and plasticizers, oils and fats, and the like contained in organic polymeric materials used for packages.

Conventionally, in order to remove such drawbacks, attempts have been made for improvement by providing a protective layer composed mainly of a water-soluble resin and a crosslinking agent on the heat-sensitive color developing layer. However, in the application of a POS label or the like, because of exposure to various opportunities for water adhesion, the heat-sensitive recording material has had a drawback that the protective layer is dissolved, image deletion and density reduction occur, and applied prints drop by water, and water resistance has had of yet been insufficient despite a slight improvement.

To overcome this problem, protective layers composed of diacetone-modified polyvinyl alcohol as the water-soluble resin and a hydrazine compound as the crosslinking agent have been proposed in Japanese Patent Application Laid-Open (JP-A) Nos. 08-151421 and 11-314457, but each has the following drawbacks: waterproofing reaction progresses in the state of a coating solution and thus its viscosity increases with time; poor water resistance is provided; increased viscosity of a coating solution for heat-sensitive color developing layer; and inhibition of color development in the heat-sensitive color developing layer by a hydrazide compound. Moreover, protective layers composed of these materials have suffered from a problem that they undesirably dissolved particularly by impregnation with such an acidic substance as edible vinegar, whereby image disappearance and print peeling occur.

BRIEF SUMMARY

In an aspect of this disclosure there is provided a heat-sensitive recording material that can impart excellent acid resistance and water resistance to an image part, and can offer excellent protective layer solution stability and color development ability. Here, since the protective layer solution contains a resin and a crosslinking agent, crosslinking reactions progress to facilitate viscosity increase and aggregation when the solution is stored over time. Therefore, that the protective layer solution stability is high means that the protective layer solution is in a stable state where no viscosity increase or aggregation occurred even after storage over time.

Various other aspects features and advantages are described herein including for example the following:

<1> A heat-sensitive recording material including:

a substrate;

a heat-sensitive color developing layer over the substrate, the heat-sensitive color developing layer composed mainly of a leuco dye and a color developer that develops color of the leuco dye upon heating; and a protective layer over the heat-sensitive color developing layer, the protective layer composed mainly of a water-soluble resin and a crosslinking agent, wherein the protective layer contains diacetone-modified polyvinyl alcohol as the water-soluble resin, and N-aminopolyacrylamide as the crosslinking agent.

<2> The heat-sensitive recording material according to <1>, wherein the N-aminopolyacrylamide has a molecular weight of 10,000 to 100,000 and a hydrazidation ratio of 50% or more.

<3> The heat-sensitive recording material according to one of <1> and <2>, wherein the protective layer contains at least one of aluminum hydroxide and calcium carbonate as a basic filler.

<4> The heat-sensitive recording material according to any one of <1> to <3>, wherein the protective layer contains a diaminostilbene compound as a fluorescent whitening agent.

<5> The heat-sensitive recording material according to any one of <1> to <4>, wherein the heat-sensitive color developing layer contains a binder, and the binder contains diacetone-modified polyvinyl alcohol.

<6> The heat-sensitive recording material according to any one of <1> to <5>, wherein the heat-sensitive color developing layer contains an acidic filler.

<7> The heat-sensitive recording material according to any one of <1> to <6>, wherein the leuco dye in the heat-sensitive color developing layer is 2-anilino-3-methyl-6-(di-n-butylamino)fluoran or 2-anilino-3-methyl-6-(di-n-pentylamino) fluoran.

<8> The heat-sensitive recording material according to any one of <1> to <7>, wherein the color developer in the heat-sensitive color developing layer is a diphenylsulfone compound contained in an amount of 2 parts by mass to 4 parts by mass per 1 part by mass of the leuco dye.

<9>. The heat-sensitive recording material according to any one of <1> to <8>, wherein between the substrate and the heat-sensitive color developing layer, an undercoat layer is provided which is composed of non-foaming plastic minute hollow particles having an average particle diameter of 0.2 μm to 20 μm and a hollow ratio of 30% to 95% and of a water-soluble resin.

<10> The heat-sensitive recording material according to any one of <1> to <9>, wherein on a back surface of the heat-sensitive recording material, a back layer is provided which is composed mainly of a pigment, a water-soluble resin, and a crosslinking agent.

<11> The heat-sensitive recording material according to any one of <1> to <10>, wherein an adhesive layer and a peeling liner are sequentially provided on a back layer surface side of the heat-sensitive recording material.

<12> The heat-sensitive recording material according to any one of <1> to <11>, wherein a magnetic recording layer is provided on a back layer surface side of the heat-sensitive recording material.

DETAILED DESCRIPTION OF THE INVENTION

Hereinafter, the present invention will be described in detail.

Diacetone-modified polyvinyl alcohol used for the water-soluble resin of a protective layer of the present invention is obtained by saponifying a resin that has been prepared by copolymerizing a diacetone group-containing monomer with vinyl ester. Often, a hydrazide compound is used as a crosslinking agent from the standpoint of reactivity. A crosslinking reaction mechanism of these materials proceeds in two stages: (1) an addition reaction of the diacetone-modified polyvinyl alcohol to a carbonyl group; and (2) a dehydrating reaction. In this way the materials are crosslinked to form film, providing water resistance. In this reaction, however, since a reverse reaction in which a dehydration reaction product having water resistance returns to an addition reaction product having no water resistance is facilitated under acidic conditions, exposure of the protective layer to acid results in dissolution of the formed film. In this case, if the crosslinking agent is a mono- or di-hydrazide compound, dissolution occurs as the dehydration reaction product returns to the addition reaction product immediately after a reactive crosslinking point is dissociated by acid; however, since N-aminopolyacrylamide used as the crosslinking agent in the present invention has a polymeric molecular structure and therefore contains a large number of hydrazide groups that can be crosslinking points in the molecule, multidimensionalization of the crosslinking points allows maintaining a film structure composed of dehydration reaction products even when some crosslinking points have been dissociated. Thus dissolution hardly occurs. As a matter of course, based on the same principle, water resistance of the obtained formed film also improves.

At this time, although it is possible to allow only the protective layer or both the heat-sensitive color developing layer and protective layer to contain N-aminopolyacrylamide, when only the heat-sensitive color developing layer contains N-aminopolyacrylamide, its crosslinking reactivity with the protective layer is weak, and dissolution easily occurs under the influence of external acidic components or water, resulting in insufficient effects.

In addition, it is preferable that N-aminopolyacrylamide have a molecular weight of 10,000 to 100,000 and a hydrazidation degree of 50% or more. A molecular weight of less than 10,000 results in easy dissociation and dissolution of crosslinking points since their polymeric molecular structure become weak. On the other hand, a molecular weight of more than 100,000 will lower its solubility to water, so that a coating solution in which it is contained become unstable. Furthermore, at a hydrazidation ratio of less than 50%, since there are a small number of hydrazide groups that can be crosslinking points in the molecule, the N-aminopolyacrylamide is inferior in crosslinking reactivity with diacetone-modified polyvinyl alcohol and thus insufficient effects result, but sufficient effects are obtained at a hydrazidation ratio of 50% or more. More preferably, the hydrazidation ratio is 80% or more.

However, the added amount of N-aminopolyacrylamide is preferably 0.05 parts by mass to 0.6 parts by mass to 1 part by mass of diacetone-modified polyvinyl alcohol contained in the protective layer. When less than 0.05 parts by mass is used, crosslinking reactivity is inferior and waterproofing reactions become insufficient, while when more than 0.6 parts by mass is used, crosslinking reactivity is raised to cause a pot life problem of the solution, and water resistance reduces owing to water solubility of the N-aminopolyacrylamide itself, far from being enhanced. A more preferable added amount of N-aminopolyacrylamide is 0.1 parts by mass to 0.4 parts by mass in light of cost and usability when used.

Moreover, it is also possible to simultaneously use, as the crosslinking agent, a hydrazine compound having hydrazide groups within a range not impairing its function, and examples thereof include, but not limited to, carbohydrazide, hydrazide oxalate, hydrazide formate, hydrazide acetate, dihydrazide malonate, dihydrazide succinate, dihydrazide adipate, hydrazide azelate, dihydrazide sebacate, dihydrazide dodecanedioate, dihydrazide maleate, dihydrazide fumarate, dihydrazide itaconate, hydrazide benzoate, dihydrazide glutarate, hydrazide diglycolate, dihydrazide tartrate, dihydrazide malate, hydrazide isophthalate, and dihydrazide terephthalate. In addition, the crosslinking agent may be combined with another known crosslinking agent.

Furthermore, it is preferable to make the heat-sensitive color developing layer contain diacetone-modified polyvinyl alcohol, as this makes a crosslinking reaction with N-aminopolyacrylamide contained in only the protective layer or the heat-sensitive color developing layer and the protective layer more likely to occur, which allows improving water resistance without adding another crosslinking agent that inhibits color development.

In addition, a filler that is contained in the protective layer or a back layer used in the present invention is preferably basic, and examples thereof include aluminum hydroxide, calcium carbonate, talc, and alkaline silicates. Among these, aluminum hydroxide and calcium carbonate are preferable in terms of matching with a thermal head (residue adhesion and wear) and the like, and aluminum hydroxide is particularly preferable in consideration of pH control due to a moderate water solubility.

In addition, as a filler contained in the heat-sensitive color developing layer, any known filler can be used. Examples thereof include, but not limited to, inorganic pigments such as calcium carbonate, aluminum oxide, zinc oxide, titanium dioxide, silica, aluminum hydroxide, barium sulfate, talc, kaolin, alumina, and clay and known organic pigments. Among these, silica, alumina, and kaolin being acidic pigments (pigments that exhibit acidity in an aqueous solution) are preferable in consideration of water resistance (water peeling resistance), and silica is particularly preferable from the standpoint of color development density.

Furthermore, for an improvement in coating ability and binding ability of the layer, a binder may be simultaneously used according to necessity. Examples thereof include, without being limited to, starches, hydroxyethyl cellulose, methyl cellulose, carboxymethyl cellulose, gelatin, casein, gum arabic, polyvinyl alcohol, diisobutylene-maleic anhydride copolymer salt, styrene-maleic anhydride copolymer salt, ethylene-acrylic acid copolymer salt, styrene-acrylic acid copolymer salt, and styrene-butadiene copolymer emulsion.

In addition, it is also possible to add a surfactant, a heat-fusible substance, a fluorescent whitening agent, and other auxiliaries according to necessity, and among these, a fluorescent whitening agent has been contained in recent years in view of whitening of the background part and excellence in appearance. From the standpoint of an effect to improve the degree of background whiteness and stability of a protective layer solution, a diaminostilbene compound is preferable. Examples thereof include 4,4'-diaminostilbene-2,2'-disulfonic acid derivatives, 4,4'-bistriazinylaminostilbene-2,2'-disulfonic acid derivatives, and the like.

The amount of addition of the fluorescent whitening agent is preferably 0.01 parts to 0.1 parts by mass to 1 part by mass of diacetone-modified polyvinyl alcohol.

A leuco dye used in the present invention is a compound exhibiting an electron-donating ability, and such compounds are used alone or in combination. For example, conventionally known leuco compounds which are per se colorless or light-colored dye precursors can be used, such as triphenylmethane phthalide leuco compounds, triallylmethane leuco compounds, fluoran leuco compounds, phenothiazine leuco compounds, thiofluoran leuco compounds, xanthene leuco compounds, indophthalyl leuco compounds, spiropyran leuco compounds, azaphthalide leuco compounds, chromenopyrazole leuco compounds, methine leuco compounds, rhodamineanilinolactam leuco compounds, rhodaminelactam leuco compounds, quinazoline leuco compounds, diaza xanthene leuco compounds, and bislactone leuco compounds.

Among these, in view of color developing properties, color fading in the image part due to humidity, heat and/or light, and the degree of background fogging of the background part, the following compounds can be cited:

2-anilino-3-methyl-6-diethylaminofluoran, 2-anilino-3-methyl-6-(di-n-butylamino)fluoran, 2-anilino-3-methyl-6-(di-n-pentylamino)fluoran, 2-anilino-3-methyl-6-(N-n-propyl-N-methylamino)fluoran, 2-anilino-3-methyl-6-(N-isopropyl-N-methylamino)fluoran, 2-anilino-3-methyl-6-(N-isobutyl-N-methylamino)fluoran, 2-anilino-3-methyl-6-(N-n-amyl-N-methylamino)fluoran, 2-anilino-3-methyl-6-(N-sec-butyl-N-ethylamino)fluoran, 2-anilino-3-methyl-6-(N-n-amyl-N-ethylamino)fluoran, 2-anilino-3-methyl-6-(N-iso-amyl-N-ethylamino)fluoran, 2-anilino-3-methyl-6-(N-cyclohexyl-N-methylamino)fluoran, 2-anilino-3-methyl-6-(N-ethyl-p-toluidino)fluoran, 2-anilino-3-methyl-6-(N-methyl-p-toluidino)fluoran, 2-(m-trichloromethylanilino)-3-methyl-6-diethylaminofluoran, 2-(m-trifluoromethylanilino)-3-methyl-6-diethylaminofluoran, 2-(m-trifluoromethylanilino)-3-methyl-6-(N-cyclohexyl-N-methylamino)fluoran, 2-(2,4-dimethylanilino)-3-methyl-6-diethylaminofluoran, 2-(N-ethyl-p-toluidino)-3-methyl-6-(N-ethylanilino)fluoran, 2-(N-methyl-p-toluidino)-3-methyl-6-(N-propyl-p-toluidino)fluoran, 2-anilino-6-(N-n-hexyl-N-ethylamino)fluoran, 2-(o-chloroanilino)-6-diethylaminofluoran, 2-(o-bromoanilino)-6-diethylaminofluoran, 2-(o-chloroanilino)-6-dibutylaminofluoran, 2-(o-fluoroanilino)-6-dibutylaminofluoran, 2-(m-trifluoromethylanilino)-6-diethylaminofluoran, 2-(p-acetylanilino)-6-(N-n-amyl-N-n-butylamino)fluoran, 2-benzylamino-6-(N-ethyl-p-toluidino)fluoran, 2-benzylamino-6-(N-methyl-2,4-dimethylanilino)fluoran, 2-benzylamino-6-(N-ethyl-2,4-dimethylanilino)fluoran, 2-dibenzylamino-6-(N-methyl-p-toluidino)fluoran, 2-dibenzylamino-6-(N-ethyl-p-toluidino)fluoran, 2-(di-p-methylbenzylamino)-6-(N-ethyl-p-toluidino)fluoran, 2-(α-phenylethylamino)-6-(N-ethyl-p-toluidino)fluoran, 2-methylamino-6-(N-ethylanilino)fluoran, 2-methylamino-6-(N-ethylanilino)fluoran, 2-methylamino-6-(N-propylanilino)fluoran, 2-ethylamino-6-(N-methyl-p-toluidino)fluoran, 2-methylamino-6-(N-methyl-2,4-dimethylanilino)fluoran, 2-ethylamino-6-(N-methyl-2,4-dimethylanilino)fluoran, 2-dimethylamino-6-(N-methylanilino)fluoran, 2-dimethylamino-6-(N-methylanilino)fluoran, 2-diethylamino-6-(N-methyl-p-toluidino)fluoran, benzoleuco methylene blue, 2-[3,6-bis(diethylamino)]-6-(o-chloroanilino)xanthyl benzoic acid lactam, 2-[3,6-bis(diethylamino)]-9-(o-chloroanilino)xanthyl benzoic acid lactam, 3,3-bis(p-dimethylaminophenyl)phthalide, 3,3-bis(p-dimethylaminophenyl)-6-dimethylaminophthalide, 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-(2-methoxy-4-dimethylaminophenyl)-3-(2-hydroxy-4,5-dichlorophenyl)phthalide, 3-(2-hydroxy-4-dimethylaminophenyl)-3-(2-methoxy-5-chlorophenyl)phthalide, 3-(2-hydroxy-4-dimethoxyaminophenyl)-3-(2-methoxy-5-chlorophenyl)phthalide, 3-(2-hydroxy-4-dimethylaminophenyl)-3-(2-methoxy-5-nitrophenyl)phthalide, 3-(2-hydroxy-4-diethylaminophenyl)-3-(2-methoxy-5-methylphenyl)phthalide, 3,6-bis(dimethylamino)fluorenespiro(9,3')-6'-dimethylaminophthalide, 6'-chloro-8'-methoxybenzoindolino-spiropyran, 6'-bromo-2'-methoxybenzoindolino-spiropyran, and the like.

Among these, in view of color developing properties, color fading in the image part due to humidity, heat and/or light, and the degree of background fogging of the background part, preferred compounds are 2-anilino-3-methyl-6-(di-n-butylamino)fluoran and 2-anilino-3-methyl-6-(di-n-pentylamino)fluoran.

The content of the leuco dye in the heat-sensitive color developing layer is preferably 5% by mass to 20% by mass, and more preferably, 10% by mass to 15% by mass.

In addition, as color developers used in the present invention, various electron-accepting substances are used that develop color by reaction with leuco dye upon heated. Examples thereof include the following phenolic compounds, organic or inorganic acidic compounds, and esters or salts thereof:

Specific examples include bisphenol A, tetrabromobisphenol A, gallic acid, salicylic acid, 3-isopropylsalicylic acid, 3-cyclohexylsalicylic acid, 3,5-di-tert-butylsalicylic acid, 3,5-di-α-methylbenzylsalicylic acid, 4,4'-isopropylidenediphenol, 1,1'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxyphenoxide, α-naphthol, β-naphthol, 3,5-xylenol, thymol, methyl-4-hydroxybenzoate, 4-hydroxyacetophenone, novolac-type phenol resin, 2,2'-thiobis(4,6-dichlorophenol), catechol, resorcin, hydroquinone, pyrogallol, phloroglycine, phloroglycine carboxylic acid, 4-tert-octylcatechol, 2,2'-methylenebis(4-chlorophenol), 2,2'-methylenebis(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, zinc 2-hydroxy-6-naphthoate, 4-hydroxydiphenylsulfone, 4-hydroxy-4'-chlorodiphenylsulfone, bis(4-hydroxyphenyl)sulfide, 2-hydroxy-p-toluic acid, zinc 3,5-di-tert-butylsalicylate, tin 3,5-di-tert-butylsalicylate, tartaric acid, oxalic acid, maleic acid, citric acid, succinic acid, stearic acid, 4-hydroxy phthalic acid, boric acid, thiourea derivative, 4-hydroxythiophenol derivative, bis(4-hydroxyphenyl)acetic acid, bis(4-hydroxyphenyl)ethyl acetate, bis(4-hydroxyphenyl)n-propyl acetate, bis(4-hydroxyphenyl)n-butyl acetate, bis(4-hydroxyphenyl)phenyl acetate, bis(4-hydroxyphenyl) benzyl acetate, bis(4-hydroxyphenyl)phenethyl acetate, bis (3-methyl-4-hydroxyphenyl)acetic acid, bis(3-methyl-4-hydroxyphenyl)methyl acetate, bis(3-methyl-4-hydroxyphenyl)n-propyl acetate, 1,7-bis(4-hydroxyphenylthio) 3,5-dioxaheptane, 1,5-bis(4-hydroxyphenylthio)-3-oxapentane, dimethyl 4-hydroxyphthalate, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-propoxydiphenylsulfone, 4-hydroxy-4'-butoxydiphenylsulfone, 4-hydroxy-4'-isopropoxydiphenylsulfone, 4-hydroxy-4'-sec-butoxydiphenylsulfone, 4-hydroxy-4'-tert-butoxydiphenylsulfone, 4-hydroxy-4'-benzyloxydiphenylsulfone, 4-hydroxy-4'-phenoxydiphenylsulfone, 4-hydroxy-4'-(m-methylbenzyloxy)diphenylsulfone, 4-hydroxy-4'-(p-methylbenzyloxy)diphenylsulfone, 4-hydroxy-4'-(o-methylbenzyloxy)diphenylsulfone, 4-hydroxy-4'-(p-chlorobenzyloxy)diphenylsulfone, 4-hydroxy-4'-oxyallyldiphenylsulfone, 2,4'-dihydroxydiphenylsulfone, and the like.

Among these, in view of high-sensitive color developing properties, color fading in the image part due to humidity, heat and/or light, and the degree of background fogging of the background part, preferred compounds are diphenylsulfone compounds such as 4-hydroxy-4'-isopropoxydiphenylsulfone, 4-hydroxy-4'-oxyallyldiphenylsulfone, and 2,4'-dihydroxydiphenylsulfone, and the most preferable added amount thereof is 2 parts by mass to 4 parts by mass per 1 part by mass of the leuco dye.

It is preferable that the heat-sensitive color developing layer further contain a heat-fusible substance. Examples thereof include: fatty acids such as stearic acid and behenic acid; fatty acid amides such as stearic acid amide, erucic acid amide, palmitic acid amide, behenic acid amide, and palmitic acid amide; N-substituted amides such as N-lauryl lauric acid amide, N-stearyl stearic acid amide, and N-oleyl stearic acid amide; bis fatty acid amides such as methylenebisstearic acid amide, ethylenebisstearic acid amide, ethylenebislauric acid amide, ethylenebiscapric acid amide, and ethylenebisbehenic acid amide; hydroxy fatty acid amides such as hydroxystearic acid amide, methylenebishydroxystearic acid amide, ethylenebishydroxystearic acid amide, and hexamethylenebishydroxystearic acid amide; fatty acid metallic salts such as zinc stearate, aluminum stearate, calcium stearate, zinc palmitate, zinc behenate; p-benzylbiphenyl, terphenyl, triphenylmethane, benzyl p-benzyloxy benzoate, β-benzyloxynaphthalene, phenyl β-naphthoate, phenyl-1-hydroxy-2-naphthoate, methyl 1-hydroxy-2-naphthoate, diphenylcarbonate, benzyl terephthalate, 1,4-dimethoxynaphthalene, 1,4-diethoxynaphthalene, 1,4-dibenzyloxynaphthalene, 1,2-diphenoxyethane, 1,2-bis(4-methylphenoxyethane), 1,4-diphenoxy-2-butene, 1,2-bis(4-methoxyphenylthio)ethane, dibenzoylmethane, 1,4-diphenylthiobutane, 1,4-diphenylthio-2-butene, 1,3-bis(2-vinyloxyethoxy)benzene, 1,4-bis (2-vinyloxyethoxy)benzene, p-(2-vinyloxyethoxy)biphenyl, p-aryloxybiphenyl, dibenzoyloxymethane, dibenzoyloxypropane, dibenzyldisulfide, 1,1-diphenylethanol, 1,1-diphenylpropanol, p-benzyloxybenzyl alcohol, 1,3-phenoxy-2-propanol, N-octadecylcarbamoyl-p-methoxycarbonylbenzene, N-octadecylcarbamoylbenzene, 1,2-bis(4-methoxyphenoxy)propane, 1,5-bis(4-methoxyphenoxy)-3-oxapentane, dibenzyl oxalate, bis(4-methylbenzyl)oxalate, bis(4-chlorobenzyl)oxalate, and the like. These may be used alone or in combination.

Furthermore, for the heat-sensitive color developing layer, besides foregoing the color developer, leuco dye, and heat-fusible substance, various materials that are commonly used to constitute heat-sensitive recording materials can be appropriately used; for example, a binder, a crosslinking agent, a pigment, a surfactant, a lubricant, and the like can be used in combination.

The method for forming the heat-sensitive color developing layer is not particularly limited, and the heat-sensitive color developing layer can be formed with a generally known method, e.g., by separately pulverizing and dispersing a leuco dye and a color developer with a binder and other ingredients using a dispersing machine such as a ball mill, ATTRITOR, or a sand mill until the diameter of dispersed particles reaches 1 μm to 3 μm and, where necessary, mixing the resultant dispersion with a filler, a heat-fusible substance (sensitizer) dispersion, and the like in certain proportions to prepare a coating solution for heat-sensitive color developing layer, followed by coating of a substrate with the coating solution.

Although the thickness of the heat-sensitive color developing layer differs depending on the composition of the heat-sensitive color developing layer, the usage of the heat-sensitive recording layer, etc., and cannot be uniquely determined, but the thickness is preferably 1 μm to 50 μm, and more preferably, 3 μm to 20 μm.

The substrate used in the present invention is not particularly limited in shape, structure, size, and the like, and can be appropriately selected according to the purpose. The shape can be, for example, a flat-plate shape and the like, the structure can be either a monolayer structure or a layered structure, and the size can be appropriately selected according to the size etc., of the heat-sensitive recording material.

The material of the substrate is not particularly limited and can be appropriately selected according to the purpose and for this, various inorganic materials and organic materials can be used. Examples of the inorganic materials include glass, quarts, silicon, silicon oxide, aluminum oxide, $SiO_2$, and metals. Examples of the organic materials include papers such as high-quality paper, art paper, coated paper, and synthesized paper; cellulose derivatives such as cellulose triacetate; and polymer films such as polyester resins such as polyethylene terephthalate (PET) and polybutylene terephthalate, polycarbonate, polystyrene, polymethylmethacrylate, polyethylene, and polypropylene. Among these, high-quality paper, art paper, coated paper, and polymer films are particularly preferable. These may be used alone or in combination.

It is preferable that, for the purpose of improving adhesion of a coating layer, the substrate be subjected to surface modification by means of corona discharge, oxidation reaction treatment (by use of chromic acid, for example), etching, easy-adhesion treatment, antistatic treatment, or the like. Moreover, it is preferable that a white pigment such as titanium oxide be added to the substrate for whitening.

Although the thickness of the substrate is not particularly limited and can be appropriately selected, this is preferably 50 μm to 2,000 μm, and more preferably, 100 μm to 1,000 μm.

An undercoat layer used in the present invention can be provided between the substrate and heat-sensitive color developing layer. Since the undercoat layer can prevent penetration of oxygen that participates in photo-oxidation reactions of leuco dye, discoloration of the background part (unprinted part) by light can be significantly suppressed.

The undercoat layer contains a binder resin and hollow particles and further contains other components according to necessity. Examples of the hollow particles include minute hollow particles having a hollow ratio of approximately 30% to 95% with a shell formed of thermoplastic resin, and porous pigments. Here, the hollow particles mean ones having a shell formed of thermoplastic resin, internally containing air and other gases, and already being in a foaming state. In addition, the hollow ratio means a ratio between the inside diameter-based volume and the outside diameter-based volume.

The minute hollow particles having a hollow ratio of approximately 30% to 95% with a shell formed of thermoplastic resin are ones internally containing air and other gases and already being in a foaming state. The average particle diameter of these minute hollow particles is preferably 0.2 μm to 20 μm, and more preferably, 0.5 μm to 10 μm. When the average particle diameter (particle outside diameter) is less than 0.2 μm, it is technically difficult to fabricate hollow particles, degrading the performance of the undercoat layer. On the other hand, when the average particle diameter is more than 20 μm, since the coated surface after dried becomes rough, resulting in non-uniform coating of the heat-sensitive color developing layer, and hence, the heat-sensitive color developing layer must be coated with an additional amount of coating solution to obtain uniformity. Therefore, it is preferable that such minute hollow particles be distributed in the particle diameter within the range as set forth the above and have a uniform distribution spectrum with little fluctuation. Furthermore, in the present invention, plastic spherical hollow particles having a hollow ratio of 30% or more can be used, however, ones having a hollow ratio of 70% or more are more preferable. Those having a hollow ratio of less than 30% are not preferable since their thermal insulating properties are insufficient and the thermal energy is therefore released outside through the substrate, thereby reducing thermal efficiency.

As described above, the minute hollow particle has a shell formed of thermoplastic resin, and for this thermoplastic resin, a vinylidene chloride- and acrylonitrile-based copolymer resins are particularly preferable.

In addition, examples of the porous pigments used in the undercoat layer include, but not limited to, organic pigments such as urea formaldehyde resins and inorganic pigments such as Shirasu soil (volcanic ash).

The method for forming the undercoat layer is not particularly limited and can be appropriately selected according to the purpose, and a method for forming the undercoat layer by applying a coating solution for undercoat layer on the heat-sensitive color developing layer is suitable.

The coating method is not particularly limited and can be appropriately selected according to the purpose, and examples thereof include spin coating, dip coating, kneader coating, curtain coating, and blade coating.

The undercoat layer may be dried after coating according to necessity. In this case, although the drying temperature is not particularly limited and can be appropriately selected according to the purpose, this is preferably 100° C. to 250° C.

The deposited amount of the undercoat layer after dried is preferably 1.0 g/m$^2$ to 5.0 g/m$^2$, and more preferably, 2.0 g/m$^2$ to 4.0 g/m$^2$.

It is preferable that the heat-sensitive recording material of the present invention have a back layer on a surface of the substrate opposite to the surface on which a heat-sensitive color developing layer is provided. The back layer contains other components such as a binder resin, a filler, a lubricant, a pigment, and a crosslinking agent.

As the binder resin, either one of a water-dispersible resin and a water-soluble resin is used, and specific examples thereof include conventionally known water-soluble polymers and aqueous polymer emulsions.

Examples of the water-soluble polymers include polyvinyl alcohol, starch and deliveries thereof, cellulose derivatives such as methoxycellulose, hydroxyethylcellulose, carboxymethylcellulose, methylcellulose, methylcellulose, and ethylcellulose, sodium polyacrylate, polyvinylpyrrolidone, an acrylamide/acrylic ester copolymer, an acrylamide/acrylic ester/methacrylate terpolymer, an alkali salt of styrene/maleic anhydride copolymer, an alkali salt of isobutylene/maleic anhydride copolymer, polyacrylamide, sodium alginate, gelatin, and casein. These may be used alone or in combination.

Examples of the aqueous polymer emulsions include emulsions of latexes such as acrylic ester copolymers, styrene/butadiene copolymers, and styrene/butadiene/acrylic copolymers, and emulsions of vinyl acetate resins, vinyl acetate/acrylic acid copolymers, styrene/acrylic ester copolymers, acrylic ester resins, polyurethane resins and the like. These may be used alone or in combination.

As the filler, either one of an inorganic filler and an organic filler can be used.

Examples of the inorganic filler include carbonates, silicates, metal oxides, and sulfated compounds. Examples of the organic filler include silicone resins, cellulose resins, epoxy resins, nylon resins, phenolic resins, polyurethane resins, urea resins, melamine resins, polyester resins, polycarbonate resins, styrene resins, acrylic resins, polyethylene resins, formaldehyde resins, and polymethyl methacrylate resins.

The method for forming the back layer is not particularly limited and can be appropriately selected according to the purpose, and a method for forming the back layer by coating a back layer coating solution on the substrate is suitable.

The coating method is not particularly limited and can be appropriately selected according to the purpose, and examples thereof include spin coating, dip coating, kneader coating, curtain coating, and blade coating.

The thickness of the back layer is not particularly limited and can be appropriately selected according to the purpose, and this is preferably 0.1 μm to 10 μm, and more preferably, 0.5 μm to 5 μm.

In a first embodiment where the heat-sensitive recording material is a heat-sensitive recording label, the heat-sensitive recording label has, on a surface (rear surface, back layer surface if with a back layer) of the substrate opposite to the side on which a heat-sensitive color developing layer is provided, an adhesive layer and a peeling liner and further has other layers according to necessity.

The material of the adhesive layer is not particularly limited and can be appropriately selected according to the purpose, and examples thereof include urea resins, melamine resins, phenolic resins, epoxy resins, vinyl acetate resins, vinyl acetate-acrylic copolymers, ethylene-vinyl acetate copolymers, acrylic resins, polyvinyl-ether resins, vinyl chloride-vinyl acetate copolymers, polystyrene resins, polyester resins, polyurethane resins, polyamide resins, chlorinated polyolefin resins, polyvinyl butyral resins, acrylic ester copolymers, methacrylic ester copolymers, natural rubbers, cyanoacrylate resins, and silicone resins. These compounds may be used alone or in combination.

Moreover, in a second embodiment, the heat-sensitive recording material has, on a surface (rear surface, back layer surface if with a back layer) of the substrate opposite to the side on which a heat-sensitive color developing layer is provided, a heat-sensitive adhesive layer that exhibits tackiness upon heated and further has other layers according to necessity.

The heat-sensitive adhesive layer contains a thermoplastic resin and a heat-fusing substance and further contains a tackifying agent according to necessity. The thermoplastic resin imparts tackiness and adhesion. The heat-fusing substance is solid at a normal temperature and therefore does not give plasticity to the resin, but fuses upon heated, swelling or softening the resin so as to exhibit tackiness. In addition, the tackifying agent functions to improve tackiness.

In a case where the heat-sensitive recording material is a heat-sensitive recording magnetic sheet, the heat-sensitive recording magnetic sheet has, on a surface (rear surface, back layer surface if with a back layer) of the substrate opposite to the side on which a heat-sensitive color developing layer is provided, a magnetic recording layer and further has other layers according to necessity.

The magnetic recording layer is formed for instance by coating of the substrate with an iron oxide, barium ferrite or the like, and with vinyl chloride, urethane resin, nylon resin or the like, or is formed by vapor deposition or sputtering without using any resin.

Although it is preferable to provide the magnetic recording layer on a surface of the substrate opposite to the side on which a heat-sensitive color developing layer is provided, this may be provided between the substrate and heat-sensitive color developing layer or on a part of the heat-sensitive color developing layer.

The shape of the heat-sensitive recording material of the present invention is not particularly limited and can be appropriately selected according to the purpose, and examples thereof include a label shape, a sheet shape, and a roll shape.

Recording using the heat-sensitive recording material of the present invention can be performed with a thermal pen or a thermal head or by laser heating depending to the purpose of use, and is not particularly limited.

The heat-sensitive recording material of the present invention can be suitably used in various fields such as POS systems for fresh foods, boxed meals, prepared foods, and the like; copying of books, documents, and the like; communications such as facsimile machines; ticket vending of ticket vending machines, receipts, and the like; and baggage tags in the airline industry.

According to the present invention, it is possible to provide a heat-sensitive recording material that can impart particularly excellent acid resistance and water resistance to an image part and further offers excellent protective layer solution stability and color development ability.

In addition, since the heat-sensitive recording material of the present invention imparts excellent storage stability to the image part and background part against water and an acidic substance such as edible vinegar and is also excellent in color development properties and print transferability by a low-torque printer in a high-temperature and high-humidity environment, this allows a heat-sensitive recording apparatus to have a simple mechanism so as to be easily reduced in size and to be produced at low cost with high handling ability of the recording material. Therefore, the heat-sensitive recording material of the present invention can be used in wide-ranging fields of information processing (output of desktop calculators, computers, and the like) medical measurement recorders, low-speed to high-speed facsimile machines, automatic ticket vending machines (train tickets and admission tickets), thermal copiers, POS system labels, and tags.

EXAMPLES

Hereinafter, the present invention will be described in greater detail with reference to Examples and Comparative Examples, however, the present invention is by no means limited in scope to these Examples. In addition, unless otherwise specified, "part(s)" and "%" mean part(s) by mass and % by mass, respectively.

Example 1

A heat-sensitive recording material was fabricated by the following procedures.

<Preparation of Coating Solution for Heat-Sensitive Color Developing Layer>

[Solution A] and [Solution B] having the following ingredients were each dispersed so that the average particle diameter becomes 1.0 μm or less by use of a sand mill, whereby a dye dispersion [Solution A] and a color developer dispersion [Solution B] were prepared.

[Solution A]

- 2-anilino-3-methyl-6-(di-n-butylamino)fluoran . . . 10 parts
- 10% aqueous solution of itaconic acid-modified polyvinyl alcohol . . . 10 parts
- Water . . . 30 parts

[Solution B]

- 4-hydroxy-4'-isopropoxydiphenylsulfone . . . 30 parts
- Tetrabromobisphenol A . . . 10 parts
- 10% aqueous solution of itaconic acid-modified polyvinyl alcohol . . . 50 parts
- Silica . . . 15 parts
- Water . . . 197 parts Next, the dye dispersion [Solution A] and color developer dispersion [Solution B] were mixed in the following proportions and stirred, whereby a heat-sensitive color developing layer coating solution [Solution C] was prepared.

[Solution C]

- Dye dispersion [Solution A] . . . 50 parts
- Color developer dispersion [Solution B] . . . 292 parts <Preparation of Coating Solution for Protective Layer>

The following ingredients were dispersed for 24 hours by use of a sand mill, whereby [Solution D] was prepared.

[Solution D]

- Aluminum hydroxide (average particle diameter: 0.6 μm, HIGILITE H-43M manufactured by Showa Denko K.K.) . . . 20 parts
- 10% aqueous solution of itaconic acid-modified polyvinyl alcohol . . . 20 parts
- Water . . . 60 parts Next, the following ingredients were mixed and stirred, whereby a coating solution for protective layer [Solution E] was prepared.

[Solution E]

- [Solution D] . . . 75 parts
- 10% aqueous solution of diacetone-modified polyvinyl alcohol . . . 100 parts
- 10% aqueous solution of N-aminopolyacrylamide (molecular weight: 10,000, hydrazidation ratio: 50%) . . . 15 parts
- 45% aqueous solution of a room-temperature curable silicone rubber . . . 0.5 parts
- 1% aqueous solution of ammonium . . . 5 parts
- Water . . . 90 parts Next, on the surface of a paper (coating paper) substrate, [Solution C] and [Solution E] were applied and dried so that the deposited amounts of the resultant heat-sensitive color developing layer and the protective layer, after dried, become 5.0 g/m$^2$ and 3.0 g/m$^2$, respectively, followed by calendar treatment so that the surface has an Oken type smoothness of about 2,000 seconds, whereby a heat-sensitive recording material of Example 1 was fabricated.

Example 2

A heat-sensitive recording material of Example 2 was fabricated in the same manner as in Example 1 except that N-aminopolyacrylamide in [Solution E] of Example 1 was changed to N-aminopolyacrylamide having a molecular weight of 20,000 and a hydrazidation ratio of 50%.

Example 3

A heat-sensitive recording material of Example 3 was fabricated in the same manner as in Example 1 except that N-aminopolyacrylamide in [Solution E] of Example 1 was changed to N-aminopolyacrylamide having a molecular weight of 90,000 and a hydrazidation ratio of 50%.

Example 4

A heat-sensitive recording material of Example 4 was fabricated in the same manner as in Example 1 except that N-aminopolyacrylamide in [Solution E] of Example 1 was changed to N-aminopolyacrylamide having a molecular weight of 10,000 and a hydrazidation ratio of 85%.

Example 5

A heat-sensitive recording material of Example 5 was fabricated in the same manner as in Example 1 except that the N-aminopolyacrylamide in [Solution E] of Example 1 was changed to N-aminopolyacrylamide having a molecular weight of 20,000 and a hydrazidation ratio of 85%.

Example 6

A heat-sensitive recording material of Example 6 was fabricated in the same manner as in Example 1 except that N-aminopolyacrylamide in [Solution E] of Example 1 was changed to N-aminopolyacrylamide having a molecular weight of 90,000 and a hydrazidation ratio of 85%.

Example 7

A heat-sensitive recording material of Example 7 was fabricated in the same manner as in Example 1 except that the added amount of the 10% aqueous solution of N-aminopolyacrylamide in [Solution E] of Example 1 was changed to 40 parts and the added amount of water was changed to 65 parts.

Example 8

A heat-sensitive recording material of Example 8 was fabricated in the same manner as in Example 1 except that aluminum hydroxide in [Solution D] of Example 1 was changed to calcium carbonate (average particle diameter: 0.5 μm, CALSHITEC Brilliant-15, manufactured by Shiraishi Kogyo Kaisha, Ltd.).

Example 9

A heat-sensitive recording material of Example 9 was fabricated in the same manner as in Example 1 except that 2-anilino-3-methyl-6-(di-n-butylamino)fluoran in [Solution A] of Example 1 was changed to 2-anilino-3-methyl-6-(di-n-pentylamino)fluoran.

Example 10

A heat-sensitive recording material of Example 10 was fabricated in the same manner as in Example 1 except that 2-anilino-3-methyl-6-(di-n-butylamino)fluoran in [Solution A] of Example 1 was changed to 2-anilino-3-methyl-6-(N-cyclohexyl-N-methylamino)fluoran.

Example 11

A heat-sensitive recording material of Example 11 was fabricated in the same manner as in Example 1 except that 4-hydroxy-4'-isopropoxydiphenylsulfone in [Solution B] of Example 1 was changed to bisphenol A.

Example 12

A heat-sensitive recording material of Example 12 was fabricated in the same manner as in Example 1 except that a coating solution for undercoat layer containing the following ingredients was prepared and applied on a substrate so that the deposited amount after dried becomes 3.0 g/m$^2$.

<Coating Solution for Undercoat Layer>

Spherical plastic hollow fine particles (styrene-acryl-based copolymer resin, solid content concentration: 27.5%, average particle diameter: 1 μm, hollow ratio: 50%) . . . 36 parts Styrene-butadiene copolymer latex (solid content: 47.5%) . . . 10 parts Water . . . 54 parts Example 13

A heat-sensitive recording material of Example 13 was fabricated in the same manner as in Example 1 except that, as a fluorescent bleaching agent, 1.5 parts of a 20% aqueous solution of a 4,4'-diaminostilbene-2,2'-disulfonic-acid-derivative was added to [Solution E] of Example 1.

Example 14

A heat-sensitive recording material of Example 14 was fabricated in the same manner as in Example 1 except that a coating solution for back layer containing the following ingredients was prepared and applied on the side of a substrate opposite to the heat-sensitive color developing layer so that the deposited amount after dried becomes 1.5 g/m$^2$.

<Coating Solution for Back Layer>

[Solution D] . . . 50 parts

10% aqueous solution of polyvinyl alcohol . . . 100 parts

10% aqueous solution of polyamideepichlorohydrin . . . 30 parts

Water . . . 100 parts

Comparative Example 1

A heat-sensitive recording material of Comparative Example 1 was fabricated in the same manner as in Example 1 except that the 10% aqueous solution of N-aminopolyacrylamide in [Solution E] of Example 1 was changed to a 10% aqueous solution of dihydrazide adipate.

Comparative Example 2

A heat-sensitive recording material of Comparative Example 2 was fabricated in the same manner as in Example 1 except that diacetone-modified polyvinyl alcohol in [Solution E] of Example 1 was changed to itaconic acid-modified polyvinyl alcohol.

Comparative Example 3

A heat-sensitive recording material of Comparative Example 3 was fabricated in the same manner as in Example 1 except that the N-aminopolyacrylamide in [Solution E] of Example 1 was changed to polyamideepichlorohydrin.

The obtained heat-sensitive recording materials were evaluated for various properties in the manner described below. The results are shown in Table 1.

<Sensitivity Ratio>

Each heat-sensitive recording material was printed by use of a thermal printing tester with a thin-film head manufactured by Matsushita Electronic Components Co., Ltd. under conditions of a head power of 0.45 W/dot, a one-line recording time of 20 msec./L, and a scanning density of 8×385 dots/mm at a pulse width of 0.2 msec. to 1.2 msec. every 1 msec., and the print density was measured by a Macbeth densitometer RD-914 to calculate a pulse width where the density becomes 1.0.

Using the pulse width measured in Comparative Example 1 as a standard, sensitivity ratio was calculated using the following equation:

(Pulse width of Comparative Example 1)/(Pulse width of a measured sample)=Sensitivity Ratio The greater the value, the more sensitive (heat responsive) the heat-sensitive recording material is.

<Edible Vinegar Resistance>

After each heat-sensitive recording material was made to contact with a 150° C.-hot stamper for 1 second for color development, the heat-sensitive recording material was immersed in a grain vinegar (manufactured by Mizukan Co., Ltd.) for 30 minutes, and image density after immersion was measured by a Macbeth densitometer (Model RD-914, manufactured by Gretag Macbeth AG) to observe a surface state of the protective layer.

<Water Resistance>

After each heat-sensitive recording material was made to contact with a 150° C.-hot stamper for 1 second for color development, the heat-sensitive recording material was immersed in water for 15 hours, and image density after immersion was measured by a Macbeth densitometer (Model RD-914, manufactured by Gretag Macbeth AG) to observe a surface state of the protective layer.

<Whiteness>

Whiteness of the background part of each heat-sensitive recording material was measured by a whiteness meter (%) in accordance with JIS P-8149.

<Back Surface Density Evaluation>

After each heat-sensitive recording material was made to contact with a 150° C.-hot stamper for 1 second for color development, the heat-sensitive recording material was laminated with three sheets of vinyl chloride wrap on the back surface side and stored in a dry environment of 50° C. under a load of 5 kg/100 $cm^2$ for 15 hours, and image density after storage was measured by a Macbeth densitometer (Model RD-914, manufactured by Gretag Macbeth AG).

<High-Temperature High-Humidity Transferability>

Under a condition of 40° C. and 95% RH, printing was performed by use of a TM-T88II printer manufactured by SEIKO EPSON CORPORATION, and the print length (mm) was measured.

<Heat Resistance>

After each heat-sensitive recording material was made to contact with a 150° C.-hot stamper for 1 second for color development, the density of the background part of the heat-sensitive recording material after standing under a dry environmental condition of 80° C. for 24 hours was measured by a Macbeth densitometer (Model RD-914, manufactured by Gretag Macbeth AG).

TABLE 1

| | Sensitivity Ratio | Edible Vinegar Resistance (image density) | Edible Vinegar Resistance (protective layer surface state) | Water Resistance (image density) | Water Resistance (protective layer surface state) | Whiteness | Back Surface density | High-Temperature High-Humidity Conveyance |
|---|---|---|---|---|---|---|---|---|
| Ex 1 | 1.00 | 1.35 | Not Dissolve | 1.26 | Not Dissolve | 82.5 | 1.20 | 103 |
| Ex. 2 | 1.00 | 1.35 | Not Dissolve | 1.25 | Not Dissolve | 82.3 | 1.20 | 103 |
| Ex. 3 | 1.00 | 1.35 | Not Dissolve | 1.25 | Not Dissolve | 83.0 | 1.21 | 103 |
| Ex. 4 | 1.01 | 1.38 | Not Dissolve | 1.27 | Not Dissolve | 82.2 | 1.20 | 103 |
| Ex. 5 | 1.00 | 1.37 | Not Dissolve | 1.26 | Not Dissolve | 82.8 | 1.22 | 103 |
| Ex. 6 | 1.01 | 1.38 | Not Dissolve | 1.28 | Not Dissolve | 82.5 | 1.20 | 103 |
| Ex. 7 | 0.99 | 1.40 | Not Dissolve | 1.32 | Not Dissolve | 82.4 | 1.21 | 103 |
| Ex. 8 | 0.99 | 1.33 | Not Dissolve | 1.24 | Not Dissolve | 83.2 | 1.20 | 103 |
| Ex. 9 | 1.04 | 1.37 | Not Dissolve | 1.26 | Not Dissolve | 83.0 | 1.23 | 103 |
| Ex. 10 | 0.98 | 1.36 | Not Dissolve | 1.23 | Not Dissolve | 82.4 | 1.19 | 103 |
| Ex. 11 | 0.97 | 1.28 | Not Dissolve | 1.22 | Not Dissolve | 82.0 | 1.18 | 103 |
| Ex. 12 | 1.15 | 1.35 | Not Dissolve | 1.26 | Not Dissolve | 82.8 | 1.28 | 103 |
| Ex. 13 | 1.02 | 1.36 | Not Dissolve | 1.27 | Not Dissolve | 88.5 | 1.21 | 103 |
| Ex. 14 | 1.00 | 1.35 | Not Dissolve | 1.26 | Not Dissolve | 82.6 | 1.30 | 103 |
| Comp. Ex. 1 | 1.00 | 1.05 | Dissolve | 1.22 | Not Dissolve | 82.4 | 1.20 | 103 |
| Comp. Ex. 2 | 0.99 | 1.27 | Not Dissolve | 0.93 | Dissolve | 82.6 | 1.21 | 25 |
| Comp. Ex. 3 | 0.98 | 0.94 | Dissolve | 1.02 | Dissolve | 81.6 | 1.18 | 98 |

What is claimed is:

1. A heat-sensitive recording material comprising:

a substrate;

a heat-sensitive color developing layer over the substrate, the heat-sensitive color developing layer composed mainly of a leuco dye and a color developer that develops color of the leuco dye upon heating; and a protective layer over the heat-sensitive color developing layer, the protective layer composed mainly of a water-soluble resin and a crosslinking agent, wherein the protective layer contains diacetone-modified polyvinyl alcohol as the water-soluble resin, and N-aminopolyacrylamide as the crosslinking agent wherein the N-aminopolyacrylamide has a molecular weight of 10,000 to 100,000 and a hydrazidation ratio of 50% or more, and wherein the protective layer contains at least one of aluminum hydroxide and calcium carbonate as a basic filler.

2. The heat-sensitive recording material according to claim 1, wherein the protective layer contains a diaminostilbene compound as a fluorescent whitening agent.

3. The heat-sensitive recording material according to claim 1, wherein the heat-sensitive color developing layer contains a binder, and the binder contains diacetone-modified polyvinyl alcohol.

4. The heat-sensitive recording material according to claim 1, wherein the heat-sensitive color developing layer contains an acidic filler.

5. The heat-sensitive recording material according to claim 1, wherein the leuco dye in the heat-sensitive color developing layer is 2-anilino-3-methyl-6-(di-n-butylamino)fluoran or 2-anilino-3-methyl-6-(di-n-pentylamino)fluoran.

6. The heat-sensitive recording material according to claim 1, wherein the color developer in the heat-sensitive color developing layer is a diphenylsulfone compound contained in an amount of 2 parts by mass to 4 parts by mass per 1 part by mass of the leuco dye.

7. The heat-sensitive recording material according to claim 1, wherein between the substrate and the heat-sensitive color developing layer, an undercoat layer is provided which is composed of non-foaming plastic minute hollow particles having an average particle diameter of 0.2 μm to 20 μm and a hollow ratio of 30% to 95% and of a water-soluble resin.

8. The heat-sensitive recording material according to claim 1, wherein on a back surface of the heat-sensitive recording material, a back layer is provided which is composed mainly of a pigment, a water-soluble resin, and a crosslinking agent.

9. The heat-sensitive recording material according to claim 1, wherein an adhesive layer and a peeling liner are sequentially provided on a back layer surface side of the heat-sensitive recording material.

10. The heat-sensitive recording material according to claim 1, wherein a magnetic recording layer is provided on a back layer surface side of the heat-sensitive recording material.

* * * * *